US005731750A

United States Patent [19]

Tatomir et al.

[11] Patent Number: 5,731,750

[45] Date of Patent: Mar. 24, 1998

[54] SPHERICAL CAVITY MODE TRANSCENDENTAL CONTROL METHODS AND SYSTEMS

[75] Inventors: Paul J. Tatomir, Laguna Niguel; Ku'ulei C. Kent, Gardena; Rolf Kich, Redondo Beach, all of Calif.

[73] Assignee: Hughes Aircraft Company, Los Angeles, Calif.

[21] Appl. No.: 593,774

[22] Filed: Jan. 29, 1996

[51] Int. Cl.[6] ..... H01P 1/207

[52] U.S. Cl. ..... 333/209; 333/232

[58] Field of Search ..... 333/202, 208, 333/209, 212, 227, 230, 231–233

[56] References Cited

U.S. PATENT DOCUMENTS

| | | | |
|---|---|---|---|
| 2,890,421 | 6/1959 | Currie et al. | 333/208 |
| 3,697,898 | 10/1972 | Blachier et al. | 333/209 X |
| 4,410,865 | 10/1983 | Young et al. | 333/208 |

*Primary Examiner*—Robert Pascal
*Assistant Examiner*—Justin P. Bettendorf
*Attorney, Agent, or Firm*—P. Y. Price; T. Gudmestad; W. K. Denson-Low

[57] ABSTRACT

The present invention discloses a microwave filter (10) for controlling the degenerate resonant modes of a spherical cavity resonator (12). The spherical cavity resonator (12) has an inner spherical surface (14) which defines a spherical cavity (16). A first and a second set of tuning elements (18) extend inward from the inner spherical surface (14) of the resonator (12) into the spherical cavity (16). One of the first set of tuning elements is located near an electromagnetic field peak, either a radial electric field peak or a surface magnetic field peak, of at least one of the degenerate modes for tuning a resonance thereof. One of the second set of tuning elements is located between electromagnetic field peaks, either radial electric or surface magnetic field peaks, of degenerate modes in at least one pair of the degenerate modes for intercoupling thereof.

19 Claims, 3 Drawing Sheets

SPHERICAL CAVITY MODE TRANSCENDENTAL CONTROL METHODS AND SYSTEMS

TECHNICAL FIELD

The present invention relates to microwave filters constructed using cavity resonators.

BACKGROUND ART

As is known in the art, low loss microwave filters can be constructed using cavity resonators. A cavity resonator comprises a metallic enclosure which defines an inner cavity for confining an electromagnetic energy signal applied thereto. The cavity resonator exhibits a number of resonant modes, each having a corresponding resonant frequency. The number of resonant modes and the resonant frequencies are dependent upon the shape and the size of the cavity.

To form a filter using cavity resonators, the modes of one or more cavity resonators are controlled, and the one or more cavity resonators are cascaded to produce a desired filter response. Typically, rectangular and cylindrical cavity resonators are utilized to construct low loss microwave filters.

Although the quality factor Q of rectangular and cylindrical resonators is high, it is known that a corresponding spherical cavity exhibits a higher theoretical Q than other-shaped cavity resonators. Further, the degeneracy or number of modes per cavity of a sphere also exceeds that of rectangular and cylindrical resonators.

Previous attempts to construct multi-order filters using spherical cavities have been unsuccessful in producing a desirable filter response. This results from the difficulty in controlling the many degenerate modes of the spherical cavity. Adequate control of five or more modes in a single spherical cavity has not been attained heretofore.

SUMMARY OF THE INVENTION

It is an object of the present invention to produce a microwave filter by selectively intercoupling and controlling the degenerate resonant modes of a spherical cavity resonator to produce a desired filter response.

It is a further object of the present invention to produce a microwave filter having an increased quality factor and a minimal insertion loss.

In carrying out the above objects and other objects and features of the present invention, a microwave filter comprising a spherical cavity resonator having an inner spherical surface which defines a spherical cavity is provided. The spherical cavity resonator supports a plurality of degenerate modes of electromagnetic energy.

A first set of tuning elements associate with the inner spherical surface of the resonator for tuning a resonance of at least one of the degenerate modes. One of the first set of tuning elements is located at or near an electromagnetic field peak, either a radial electric or a surface magnetic field peak, of the at least one of the degenerate modes.

A second set of tuning elements associate with the inner spherical surface of the resonator for intercoupling at least one pair of the degenerate modes. One of the second set of tuning elements is located between electromagnetic field peaks, either radial electric or surface magnetic field peaks, of degenerate modes in the at least one pair of the degenerate modes.

Further in carrying out the above objects, the present invention provides a method for intercoupling and controlling a plurality of degenerate modes supported by a spherical cavity resonator having an inner spherical surface which defines a spherical cavity. The method includes the steps of associating a first and a second set of tuning elements with the inner spherical surface of the resonator. The next step is to tune a resonance of at least one of the degenerate modes by locating one of the first set of tuning elements near an electromagnetic field peak of the at least one of the degenerate modes. At least one pair of the degenerate modes are then intercoupled by locating one of the second set of tuning elements between electromagnetic field peaks of the degenerate modes in the at least one pair of the degenerate modes.

Embodiments of the present invention exhibit numerous advantages. The effective control of the spherical cavity modes permits the realization of multi-order filters with improved electrical performance. Further, filter mass is significantly decreased in comparison to current designs since a single spherical cavity can possess up to any odd number of degenerate resonances. Moreover, embodiments of the present invention provide greater electrical design flexibility.

These and other features, aspects, and advantages of the present invention will become better understood with regard to the following description, appended claims, and accompanying drawings.

BEST MODE FOR CARRYING OUT THE INVENTION

Figure 1:
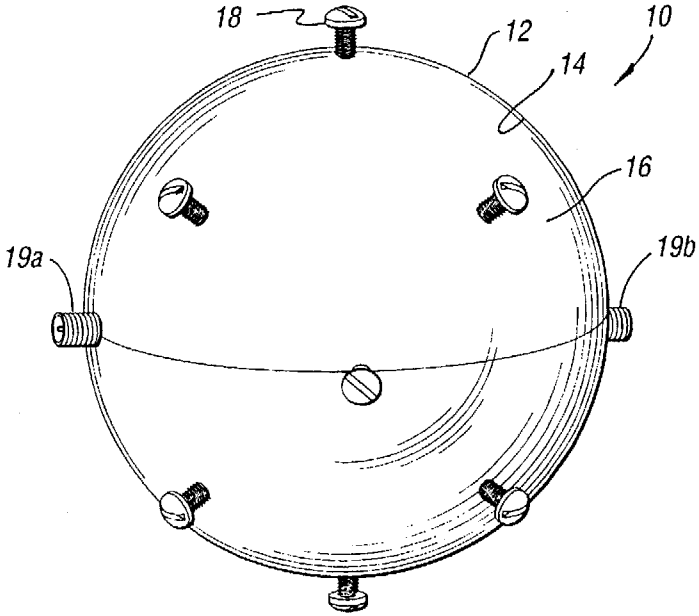
FIG. 1 illustrates a microwave filter according to the present invention.

A microwave filter 10 according to the teachings of the present invention is illustrated in FIG. 1. Microwave filter 10 includes a spherical cavity resonator 12 having an inner spherical surface 14 which defines a spheroid or a spherical cavity 16. Spherical cavity resonator 12 supports a plurality of degenerate modes of electromagnetic energy. A plurality of tuning elements generally designated as reference numeral 18 extends radially inward from inner spherical surface 14 into spherical cavity 16. Spherical cavity resonator 12 has an input coaxial connector 19*a* and an output coaxial connector 19*b*. Connectors 19*a* and 19*b* are coupled to respective input and output transmission lines (not shown).

Spherical cavity 16 resonates with modes TE or TM with respect to the radial direction. The degeneracy of each mode is an odd integer starting with three. Hence, any odd order cavity resonator filter can theoretically be constructed using a spherical TE or TM mode. All, or some of these degenerate resonant modes can be employed in the filter function if they are excited. For example, the second TM mode, $TM_{m21}$, has a fivefold degeneracy and can be used to make up to a fifth order filter. A fourth order filter can be made by not exciting one of the five resonances. Since spherical modes occur with degeneracies of 3, 5, 7, 9, . . . , etc., any filter of order N (where N is an integer greater than or equal to one) can be constructed depending upon which modes are excited when using a TE or TM mode. The TE or TM mode to use and which modes to excite depend on various filter requirements as well as the desired filter order.

Tuning elements 18 are located at predetermined locations to selectively intercouple and control the degenerate modes of spherical cavity 16. Tuning elements 18 are shown in FIG. 1 as metallic screws. As is well known in the microwave field, tuning elements 18 may also be metallic coupling loops extending into spherical cavity 16. Furthermore, inner spherical surface 16 may have dimples, nipples, flats, protrusions, extrusions, or the like to intercouple and control the degenerate modes of spherical cavity 16 in the same manner as the metallic screws and loops.

For instance, a tuning screw located at or near a radial electric field peak of a degenerate mode will tune this mode. A tuning screw located between radial electric field peaks of degenerate modes in a pair of degenerate modes will intercouple these modes. Similarly, a tuning loop located at or near a surface, or transverse, magnetic field peak will tune this mode and a tuning loop located between surface magnetic field peaks of degenerate modes will intercouple these modes. As will be described in further detail below, the present invention discloses a scheme for utilizing a plurality of tuning elements to tune and intercouple all of the degenerate modes in order to construct a desired filter response.

Figure 2A:
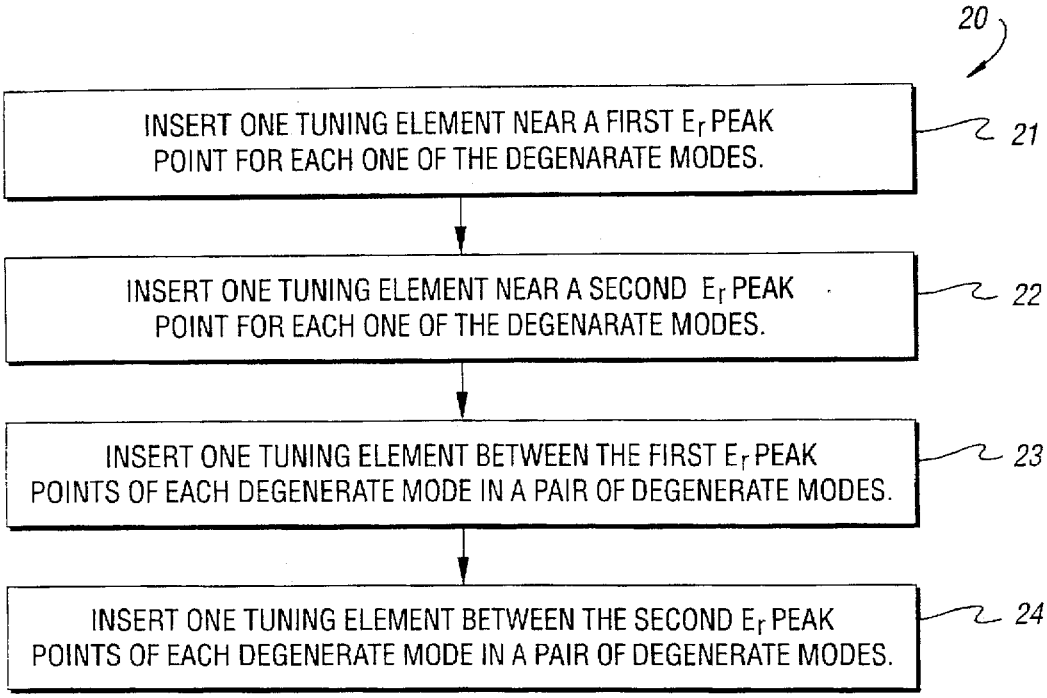
FIG. 2*a* is a flowchart illustrating the method steps for intercoupling and controlling a plurality of $TM_{mnp}$ degenerate modes supported by a spherical cavity resonator.

With continued reference to FIG. 1, FIG. 2*a* shows a method flowchart 20 depicting four steps for selectively intercoupling and controlling a plurality of $TM_{mnp}$ degenerate modes supported by spherical cavity resonator 12. First, insert one tuning element into spherical cavity 16 near a first radial electric field peak for each of the degenerate modes as shown in block 21. Second, insert one tuning element into spherical cavity 16 near a second radial electric field peak for each of the degenerate modes as shown in block 22. As taught above, the steps in blocks 21 and 22 tune the resonance of each degenerate mode.

Third, insert one tuning element for each pair of degenerate modes into spherical cavity 16 between first radial electric field peaks of each degenerate mode in a pair of degenerate modes as shown in block 23. Finally, insert one tuning element for each pair of degenerate modes into spherical cavity 16 between second radial electric field peaks of each degenerate mode in a pair of degenerate modes as shown in block 24. As taught above, the steps in blocks 23 and 24 intercouple each pair of degenerate modes. Tuning elements used in method flowchart 20 are preferably metallic screw elements.

Figure 2B:
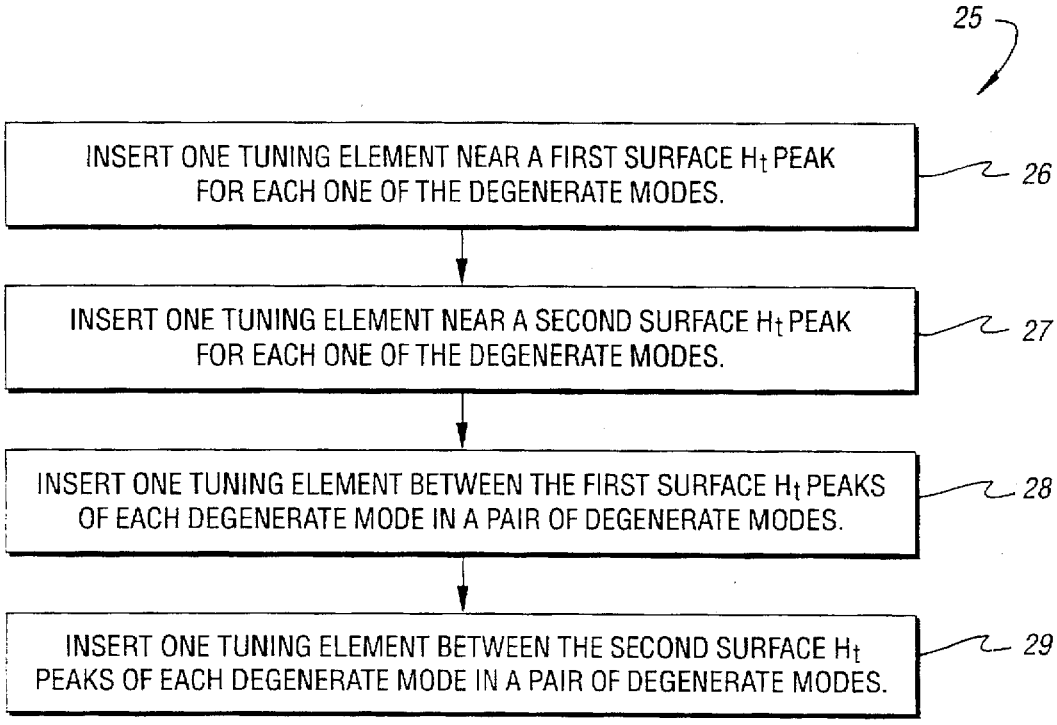
FIG. 2*b* is a flowchart illustrating the method steps for intercoupling and controlling a plurality of $TE_{mnp}$ degenerate modes supported by a spherical cavity resonator.

For intercoupling and controlling a plurality of $TE_{mnp}$ degenerate modes supported by spherical cavity resonator 12, each step of method flowchart 20 is modified in FIG. 2*b* so that each tuning element is inserted between surface magnetic field peaks as shown by method flowchart 25. A tuning element is inserted near a first and a second surface magnetic field peak of each degenerate modes as shown in blocks 26 and 27. These steps tune the resonance of each degenerate mode. To intercouple these modes, a tuning element is inserted between first surface magnetic peaks and another tuning element is inserted between second surface magnetic peaks of each degenerate mode in a pair of degenerate modes as shown by blocks 28 and 29. Tuning elements used in method flowchart 25 are preferably metallic coupling loops.

The method described herein is applied to the fivefold $TM_{m21}$ mode. A study of the $TM_{m21}$ degenerate modes shows that the radial electric field $E_r$ is proportional to the associated Legendre Polynomial $P^m_n(\cos\theta)$. In this case, n=2 and m=0, ±1, or ±2. The five degenerate resonant modes have the following radial electrical field components in spherical coordinates given in Table I.

TABLE I

| NAME | MODE | $E_r$ |
|---|---|---|
| A | $TM_{221}$ odd | $R(r)\sin(2\phi)P_2^2(\cos\theta)$ |
| B | $TM_{221}$ even | $R(r)\cos(2\phi)P_2^2(\cos\theta)$ |
| C | $TM_{121}$ even | $R(r)\cos(\phi)P_2^1(\cos\theta)$ |
| D | $TM_{121}$ odd | $R(r)\sin(\phi)P_2^1(\cos\theta)$ |
| E | $TM_{021}$ polar | $R(r)P_2^0(\cos\theta)$ |

R(r) is proportional to 1/r^2 $\hat{J}_n(kr)$ where r equals the radial distance from the center of the sphere, n=2 and k is a constant wavenumber. $\hat{J}_n(kr)$ is the spherical Bessel function of order n.

To tune a resonance of a mode, an inward radial tuning element is required at or near an $E_r$ peak point The peak point is a function of $\cos(m\phi)\ P^m_n(\cos\theta)$ or $\sin(m\phi)\ P^m_n(\cos\theta)$ depending on the mode considered Usually, the tuning of a resonance of one mode has another effect such as forming a coupling to other modes. If that is not desired, then another tuning element can be inserted at or near another $E_r$ peak point of the mode to create the opposite effect, thus cancelling or controlling the amount of coupling with other modes. Often, a number of screws are simultaneously adjusted to control the same number of electrical variables. Intermode coupling and resonance tuning is transcendental.

To intercouple a pair modes, a tuning element is placed between the radial electric field peak of each mode in the pair of modes. Again, this element may create another undesired coupling in which case another coupling element needs to be inserted between two other radial electric field peaks of each mode in the pair of modes to null out or control the coupling effect. Certain modes can be isolated from intermode coupling by operating at tesseral harmonic zone nulls.

The key to mode control is the study and superposition of the tesseral or zonal harmonics on the spherical surface. In short, an investigation of tesseral zonal harmonics is used in conjunction with simultaneous solutions of more than one variable to accomplish resonance tuning and intermode couplings of the spherical modes.

Figure 3:
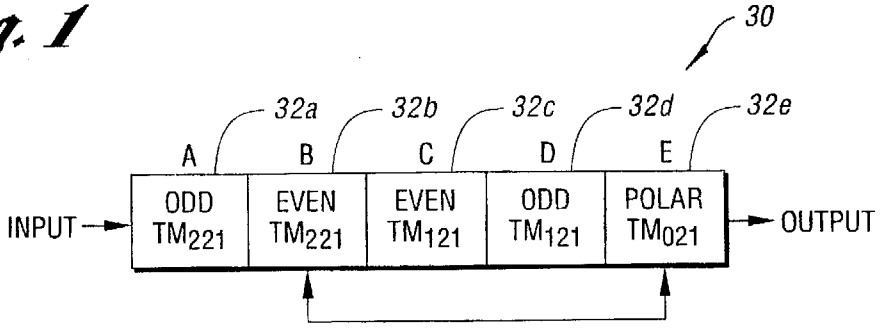
FIG. 3 illustrates a coupling scheme for the spherical $TM_{m21}$ five degenerate modes.

For example, consider the spherical $TM_{m21}$ mode where n=2 and m=0, ±1 or ±2 in which five degenerate resonant modes occur. The modes can be coupled as shown in FIG. 3 to form a fifth order cross-coupled filter pattern 30. In particular, the $TM_{221}$ odd mode indicated by 32*a* is coupled to the $TM_{221}$ even mode indicated by 32*b*. Similarly, $TM_{221}$ even mode 32*b* is coupled to the $TM_{121}$ even mode indicated by 32*c*. This cross coupling pattern is repeated with respect to $TM_{121}$ odd mode 32*d* and $TM_{021}$ polar mode 32*e*. With reference to the letter name designations of Table I, fifth order cross-coupled filter has the following pairs of modes intercoupled: modes A and B, modes B and C, modes C and D, modes D and E, and modes B and E.

Figure 4:
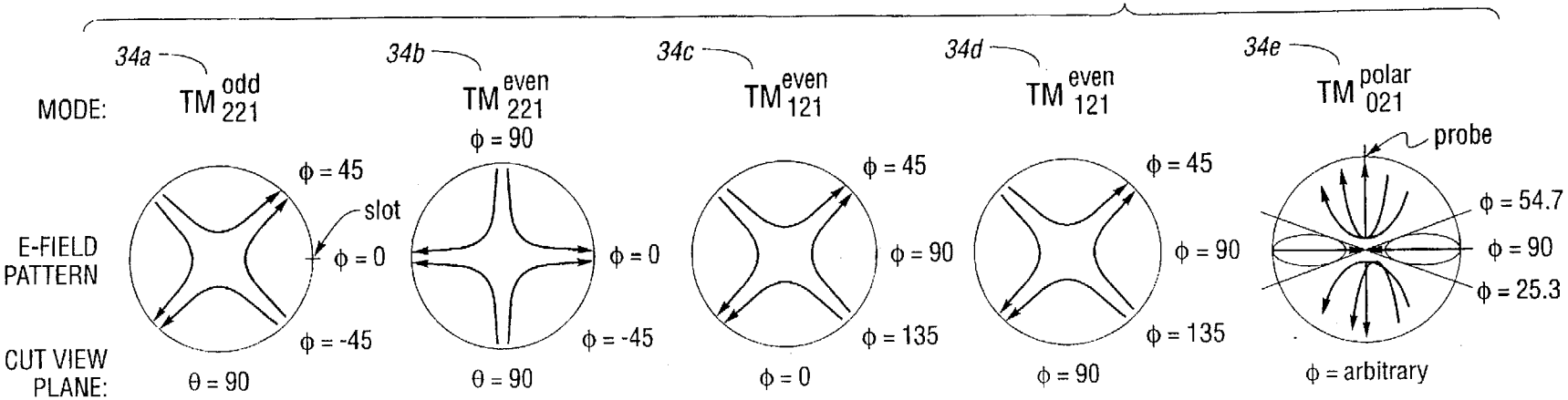
FIG. 4 illustrates the radial electric field $E_r$ pattern for each of the five $TM_{m21}$ degenerate modes.

FIG. 4 illustrates the radial electric field $E_r$ pattern for each of the five $TM_{m21}$ degenerate resonant modes. $TM_{221}$ odd mode indicated by 34*a* has electric field peak points at $\phi$=45°, 135°, 225°, and −45° when θ=90°. $TM_{221}$ even mode indicated by 34*b* has electric field peak points at $\phi$=0°, 90°, 180°, and 270° when θ=90°. $TM_{121}$ even mode indicated by 34*c* has electric field peak points at θ=45° and 135° when $\phi$=0°. $TM_{121}$ odd mode indicated by 34*d* has electric field peak points at θ=45° and 135° when $\phi$=90°. Finally, $TM_{021}$ polar mode indicated by 34*e* has electric field pattern as indicated in FIG. 4. These electric field patterns radiate as illustrated for each of the modes when the input to the filter is a $\hat{\theta}$-directed slot centered at θ=90° and $\phi$=0°. The output is a probe at θ=0°.

The radial screw positions used to intercouple the modes are given in Table II.

TABLE II

| COUPLING | θ | ϕ | COMMENTS |
|---|---|---|---|
| A to B | 90° | 157.5° | Placed at $P_2^1$ (cosθ) = 0 for mode C and |
| | 90° | −112.5° | D isolation. |
| B to C | 54.74° | 180° | Placed at $P_2^0$ (cosθ) = 0 for mode E |
| | 125.26° | 180° | isolation. |
| C to D | 54.74° | 135° | Same as above. |
| | 125.26° | 135° | |
| D to E | 45° | 90° | Inherent coupling to mode B must be |
| | 112.5° | 90° | simultaneously negated. |
| | 125.26° | −90° | |
| B to E | 25.5° | −90° | Equatorial elements of mode A below |
| | 154.5° | 90° | are imbalanced to zero out mode A–E coupling. |

The radial screw positions used to control the resonant frequencies of the modes are given in Table III.

TABLE III

| MODE | θ | ϕ | COMMENTS |
|---|---|---|---|
| A | 90° | −135° | Place at $P_2^1$ (cos θ) = 0 for modes C and |
| | 90° | 135° | D isolation. Used in pairs to control coupling to mode E. |
| B | 90° | 90° | Same as above. |
| | 90° | 180° | |
| C | 54.74° | 180° | Place at $P_2^0$ (cos θ) = 0 for mode E |
| | 125.26° | 180° | isolation. Imbalance creates coupling to mode B. |
| D | 54.74° | −90° | Same as above. |
| | 125.26° | −90° | |
| E | 0°, 180° | Any Value | All others isolated. |

The same approach can be applied to a five-fold TE mode or to a higher order TM or TE mode to form a 7, 9, 11, etc. degree filter. Furthermore, the teachings of the present invention are applicable to $V_n$ and $V_p$ modes. The use of loops or dimples on the inner surface of the sphere can be used to intercouple and control magnetic fields in a similar fashion.

A combination of tuning screws and magnetic coupling loops extending into the spherical cavity, or dimples, nipples, and flats on the inner spherical surface may be used to selectively intercouple control the resonant frequencies of the modes. This permits filter function realization using these extremely high Q modes.

To illustrate the concept in detail, consider the coupling of mode A to mode B. These are the $TM_{221}$ odd and even modes respectively. The radial electric fields were previously given in terms of sinusoidal functions and associated Legendre polynomials in $\phi$ and θ, respectively.

Let $X_n$ denote the radial electric field of mode X at screw position n. The electric field dot products at locations 1 and 2 are set such that:

$$A_1*B_1+A_2*B_2=K_{AB}$$

$$A_1*E_1+A_2*E_20$$

$$B_1*E_1+B_2*E_2=0$$

Coupling $K_{AB}$ is maximized when θ=90°, $\phi_1$=22.5°±45° m, and $\phi_2=\phi_1$+90° where m is any integer.

Here, two tuning elements, or screws, are used to couple two modes and isolate them from another mode. Specifically, a screw at (θ=90°, $\phi_1$=22.5°±45° m) and at (θ=90°, $\phi_2=\phi_1$+90°) of equal penetration are required to couple modes A and B yet isolate the polar mode E. They are placed midway between mode A and B electric field peaks and are separated by 90° in the $\phi$-direction.

Modes C and D are also isolated from either of modes A or B because at θ=90°, the radial electric field of both the C and D modes is equal to 0. Hence, the electric field dot product at locations 1 and 2 where θ=90° are set such that:

$$A_1*C_1+A_2*C_2=0$$

$$A_1*D_1+A_2*D_2=0$$

$$B_1*C_1+B_2*C_2=0$$

$$B_1*D_1+B_2*D_2=0$$

Figure 5:
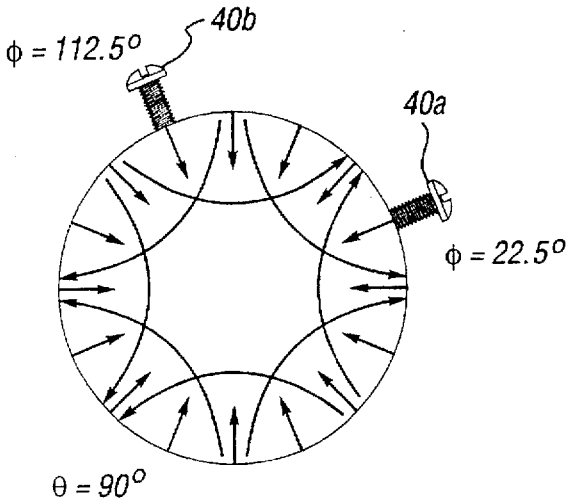
FIG. 5 illustrates the coupling pattern of the radial electric fields of two of the five $TM_{m21}$ degenerate modes caused by inserting coupling tuning elements into the spherical cavity.

Thus, modes A and B are intercoupled while eliminating coupling with modes C, D and E by placing a tuning element at (θ=90°, $\phi_1$=22.5°±45° m) and at (θ=90°, $\phi_2=\phi_1$+90°). FIG. 5 shows the coupling pattern of the radial electric fields of modes A and B caused by inserting a tuning element 40*a* at (θ=90°, $\phi_1$=22.5°) and a tuning element 40*b* at (θ=90°, $\phi_2$, =112.5°).

As can be appreciated by those skilled in the art, the other modes may be intercoupled while eliminating undesired coupling by placing a tuning element at the coordinates listed in Table II. The tuning elements at these locations maximize and minimize the electric field dot products as taught above.

Two additional screws each for modes A and B are required at θ=90° to tune their resonant frequencies. As with the A to B coupling, equal penetrations are needed to isolate them from the polar mode E. These resonance tuners are placed on the radial electric field peaks of the respective mode and are 90° apart in $\phi$.

For mode A, the $TM_{221}$ odd mode, the tuners are placed at $\phi$=−135° and 135°. Since sin(2θ) switches sign from −135° to 135°, the tuning screws can negate mode A to E coupling with equal penetration or else control this coupling via screw imbalancing. Therefore, two tuning screws are used simultaneously to tune mode A resonance and control coupling of mode A to E. Tuning screws at $\phi_1$=−135° and $\phi_2$=135° when θ=90° negate mode A to E coupling because the electric field dot products cancel each other out, e.g., $A_2*E_2=-A_1*E_1$.

Mode B is isolated because at $\phi$=−135° and 135°, cos(2$\phi$) is equal to 0. Hence, $A_1*B_1+A_2*B_2=0$. Similarly, modes C and D are isolated from mode A because $P^1_2$(cosθ)=0 when θ=90°. Hence $A_1*C_1+A_2*C_2=0$ and $A_1*D_1+A_2*D_2=0$. Thus, placing tuning elements at θ=−135° and 135° when $\phi$=90° tunes the resonance of mode A while eliminating any coupling with modes B, C, D, and E.

Figure 6:
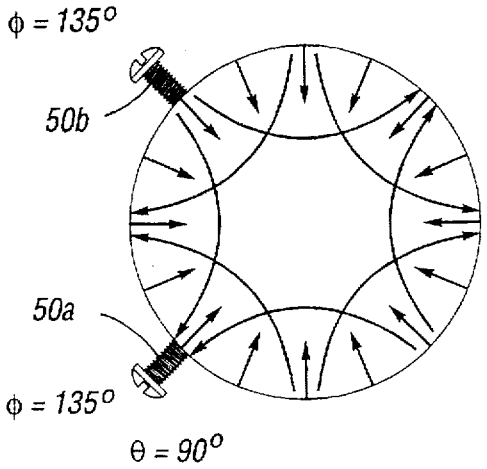
FIG. 6 illustrates the pattern of the radial electric fields of FIG. 5 caused by inserting resonance tuning elements into the spherical cavity.

FIG. 6 shows the electric field pattern of the radial electric fields of FIG. 5 caused by inserting resonance tuning elements 50*a* and 50*b* at $\phi_1=-135°$ and $\phi_2=135°$ respectively when $\theta=90°$.

As can be appreciated by those skilled in the art, modes B, C, D, and E may be tuned to their resonant frequencies while eliminating undesired coupling by placing a tuning element at the coordinates listed in Table III.

Figure 7:
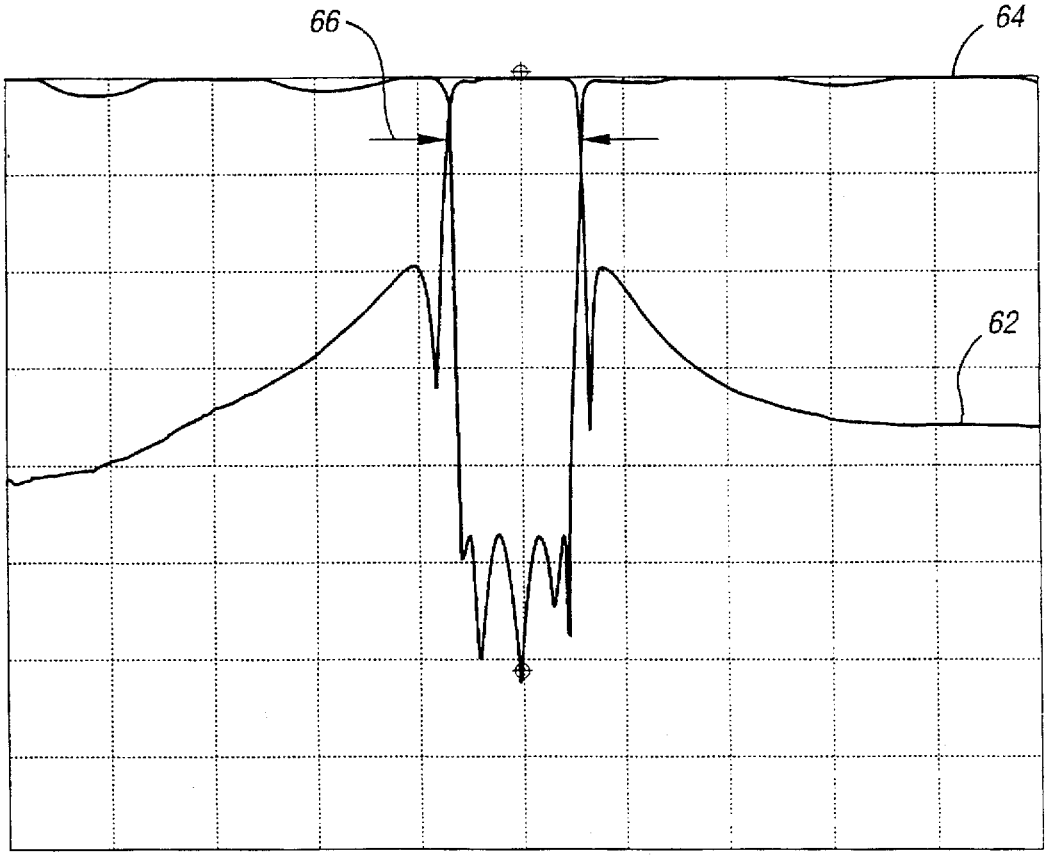
FIG. 7 is a graph illustrating the measured response of the fifth order microwave filter.

FIG. 7 is a graph illustrating an insertion loss trace 62 and a return loss trace 64 for the fifth order $TM_{m21}$ spherical microwave filter. The filter has a bandwidth 66 of 52.4 mHz and a return loss of 24 dB in the passband region.

This is the basis of the spherical mode control scheme. Careful study of the mode patterns shows that control is possible for all modes. The data for the fifth order filter demonstrates the realizability of this approach. The same approach is applicable to higher and lower spherical degenerate modes.

It is to be understood, of course, that while the form of the present invention described above constitutes the preferred embodiment of the present invention, the preceding description is not intended to illustrate all possible forms thereof. It is also to be understood that the words used are words of description, rather than limitation, and that various changes may be made without departing from the spirit and scope of the present invention, which should be construed according to the following claims.

What is claimed is:

1. A multi-order microwave filter having a desired multi-order filter response comprising:

a spherical cavity resonator having an inner spherical surface which defines a spherical cavity, said spherical cavity resonator supporting at least five degenerate modes of electromagnetic energy;

a first set of tuning elements associated with the inner spherical surface of the spherical cavity resonator for tuning a resonance of at least one of the degenerate modes, wherein one of the first set of tuning elements is located near an electromagnetic field peak of the at least one of the degenerate modes; and a second set of tuning elements associated with the inner spherical surface of the spherical cavity resonator for intercoupling at least one pair of the degenerate modes, wherein one of the second set of tuning elements is located between electromagnetic field peaks of degenerate modes in the at least one pair of the degenerate modes.

2. The microwave filter of claim 1 wherein the first set of tuning elements includes a respective pair of tuning elements for each of the at least one of the degenerate modes.

3. The microwave filter of claim 2 wherein a first tuning element of one pair of tuning elements is located near a first radial electric field peak of a respective one of the at least one of the degenerate modes.

4. The microwave filter of claim 2 wherein a second tuning element of one pair of tuning elements is located near a second radial electric field peak of a respective one of the at least one of the degenerate modes.

5. The microwave filter of claim 2 wherein a first tuning element of one pair of tuning elements is located near a first surface magnetic field peak of a respective one of the at least one of the degenerate modes.

6. The microwave filter of claim 2 wherein a second tuning element of one pair of tuning elements is located near a second surface magnetic field peak of a respective one of the at least one of the degenerate modes.

7. The microwave filter of claim 1 wherein the second set of tuning elements includes a respective pair of tuning elements for each of the at least one pair of the degenerate modes.

8. The microwave filter of claim 7 wherein a first tuning element of one pair of tuning elements is located between first radial electric field peaks of the degenerate modes in a respective pair of the at least one pair of the degenerate modes.

9. The microwave filter of claim 7 wherein a second tuning element of one pair of tuning elements is located between second radial electric field peaks of the degenerate modes in a respective pair of the at least one pair of the degenerate modes.

10. The microwave filter of claim 7 wherein a first tuning element of one pair of tuning elements is located between first surface magnetic field peaks of the degenerate modes in a respective pair of the at least one pair of the degenerate modes.

11. The microwave filter of claim 7 wherein a second tuning element of the one pair of tuning elements is located between second surface magnetic field peaks of the degenerate modes in a respective pair of the at least one pair of the degenerate modes.

12. A microwave filter having an order N of at least five to produce a desired N order filter response, the microwave filter comprising:

a spherical cavity resonator supporting N degenerate TM modes of electromagnetic energy, each one of the N degenerate TM modes having a first and a second radial electric field peak, the N degenerate TM modes defining N-1 degenerate TM mode pairs;

a plurality of first tuning elements, each of the first tuning elements extending into the resonator near the first radial electric field peak of a respective one of the N degenerate TM modes for tuning a respective resonance thereof;

a plurality of second tuning elements, each of the second tuning elements extending into the resonator near the second radial electric field peak of a respective one of the N degenerate TM modes to control an undesired coupling of the N degenerate TM modes caused by the first tuning elements;

a plurality of third tuning elements, each of the third tuning elements extending into the resonator between the first radial electric field peaks of a respective pair of the N degenerate TM modes to intercouple the N-1 degenerate TM mode pairs; and a plurality of fourth tuning elements, each of the fourth tuning elements extending into the resonator between the second radial electric field peaks of a respective pair of the N degenerate TM modes to control an undesired coupling of the N degenerate TM modes caused by the third tuning elements.

13. The microwave filter of claim 12 wherein each one of the tuning elements includes a metallic screw.

14. A microwave filter having an order N of at least five to produce a desired N order filter response, the microwave filter comprising:

a spherical cavity resonator supporting N degenerate TE modes of electromagnetic energy, each one of the N degenerate TE modes having a first and a second surface magnetic field peak, the N degenerate TE modes defining N-1 degenerate TE mode pairs;

a plurality of first tuning elements, each of the first tuning elements extending into the resonator near the first surface magnetic field peak of a respective one of the N degenerate TE modes for tuning a respective resonance thereof;

a plurality of second tuning elements, each of the second tuning elements extending into the resonator near the second surface magnetic field peak of a respective one of the N degenerate TE modes to control an undesired coupling of the N degenerate TE modes caused by the first tuning elements;

a plurality of third tuning elements, each of the third tuning elements extending into the resonator between the first surface magnetic field peaks of a respective pair of the N degenerate TE modes to intercouple the N-1 degenerate TE mode pairs; and a plurality of fourth tuning elements, each of the fourth tuning elements extending into the resonator between the second surface magnetic field peaks of a respective pair of the N degenerate TE modes to control an undesired coupling of the N degenerate TE modes caused by the third tuning elements.

15. A method for selectively intercoupling and controlling at least five degenerate modes supported by a spherical cavity resonator to produce a desired multi-order filter response, wherein the spherical cavity resonator has an inner spherical surface which defines a spherical cavity, said method comprising the steps of:

associating a first set of tuning elements with the inner spherical surface of the spherical cavity resonator;

tuning a resonance of at least one of the degenerate modes by locating one of the first set of tuning elements near an electromagnetic field peak of the at least one of the degenerate modes;

associating a second set of tuning elements with the inner spherical surface of the spherical cavity resonator; and intercoupling at least one pair of the degenerate modes by locating one of the second set of tuning elements between electromagnetic field peaks of degenerate modes in the at least one pair of the degenerate modes.

16. The method of claim 15 further comprising the steps of:

providing a respective pair of tuning elements from the first set of tuning elements for each of the at least one of the degenerate modes;

locating a first tuning element of one pair of the first set of tuning elements near a first radial electric field peak of a respective one of the at least one of the degenerate modes; and locating a second tuning element of the one pair of the first set of tuning elements near a second radial electric field peak of the respective one of the at least one of the degenerate modes.

17. The method of claim 15 further comprising the steps of:

providing a respective pair of tuning elements from the second set of tuning elements for each of the at least one pair of the degenerate modes;

locating a first tuning element of one pair of the second set of tuning elements between first radial electric field peaks of the degenerate modes in a respective pair of the at least one pair of the degenerate modes; and locating a second tuning element of the one pair of the second set of tuning elements between second radial electric field peaks of the degenerate modes in the respective pair of the at least one pair of the degenerate modes.

18. The method of claim 15 further comprising the steps of:

providing a respective pair of tuning elements from the first set of tuning elements for each of the at least one of the degenerate modes;

locating a first tuning element of one pair of the first set of tuning elements near a first surface magnetic field peak of a respective one of the at least one of the degenerate modes; and locating a second tuning element of the one pair of the first set of tuning elements near a second surface magnetic field peak of the respective one of the at least one of the degenerate modes.

19. The method of claim 15 further comprising the steps of:

providing a respective pair of tuning elements from the second set of tuning elements for each of the at least one pair of the degenerate modes;

locating a first tuning element of one pair of the second set of tuning elements between first surface magnetic field peaks of the degenerate modes in a respective pair of the at least one pair of the degenerate modes; and locating a second tuning element of the one pair of the second set of tuning elements between second surface magnetic field peaks of the degenerate modes in the respective pair of the at least one pair of the degenerate modes.

* * * * *